US005652569A

United States Patent [19]

Gerstenberger et al.

[11] Patent Number: 5,652,569

[45] Date of Patent: Jul. 29, 1997

[54] CHILD ALARM

[75] Inventors: Paul Joseph Gerstenberger, 1300 - 30th #E3-22, Boulder, Colo. 80303; Bryan H. Weitzel, Longmont, Colo.

[73] Assignee: Paul Joseph Gerstenberger, Boulder, Colo.

[21] Appl. No.: 300,450

[22] Filed: Sep. 2, 1994

[51] Int. Cl.[6] ..... G08B 23/00

[52] U.S. Cl. ..... 340/573; 340/539; 340/574; 340/328; 340/693; 455/100; 455/351

[58] Field of Search ..... 340/574, 573, 340/539, 311.1, 825.49, 693, 328, 571; 455/100, 88–90, 67.7, 53.1, 49.1, 347, 351

[56] References Cited

U.S. PATENT DOCUMENTS

| | | | |
|---|---|---|---|
| 4,136,338 | 1/1979 | Antenore | 340/568 X |
| 4,476,469 | 10/1984 | Lander | 340/539 X |
| 4,593,273 | 6/1986 | Narcisse | 340/539 |
| 4,694,284 | 9/1987 | Leveille et al. | 340/574 |
| 4,785,291 | 11/1988 | Hawthorne | 340/573 |
| 4,888,580 | 12/1989 | Distel | 340/573 |
| 4,899,135 | 2/1990 | Ghahariiran | 340/573 |
| 4,973,944 | 11/1990 | Maletta | 340/568 |
| 4,999,613 | 3/1991 | Williamson et al. | 340/573 |
| 5,021,794 | 6/1991 | Lawrence | 340/573 X |
| 5,115,223 | 5/1992 | Moody | 340/573 |
| 5,119,072 | 6/1992 | Hemingway | 340/573 |
| 5,175,868 | 12/1992 | Yasuoka | 340/573 X |
| 5,196,825 | 3/1993 | Young | 340/573 X |
| 5,223,815 | 6/1993 | Rosenthal et al. | 340/571 X |
| 5,235,322 | 8/1993 | Obysovsky et al. | 340/574 |
| 5,245,314 | 9/1993 | Kah, Jr. | 340/573 X |
| 5,289,163 | 2/1994 | Perez et al. | 340/573 X |
| 5,298,883 | 3/1994 | Pilney et al. | 340/573 |
| 5,307,763 | 5/1994 | Arthur et al. | 340/573 X |
| 5,337,041 | 8/1994 | Friedman | 340/573 |
| 5,357,254 | 10/1994 | Kah, Jr. | 340/573 X |
| 5,389,915 | 2/1995 | Chen | 340/573 |
| 5,402,104 | 3/1995 | La Rosa | 340/571 X |

FOREIGN PATENT DOCUMENTS

| | | | |
|---|---|---|---|
| 2132804 | 7/1984 | United Kingdom | 340/571 |
| 2228814 | 9/1990 | United Kingdom | 340/571 |
| 2236000 | 3/1991 | United Kingdom | 340/571 |
| 19437 | 9/1993 | WIPO | 340/571 |

*Primary Examiner*—Thomas Mullen
*Attorney, Agent, or Firm*—Rick Martin

[57] ABSTRACT

A child alarm device consists of a guardian's transmitter and a child's receiver. The transmitter is held or carried by the guardian. The receiver is mounted inside a backpack worn by the child. If the child wanders out of range of the guardian's transmitter, after a short delay an audible alarm is triggered in the child's backpack automatically. One of the child's alarms can be triggered manually by the guardian. As an optional "Panic Button", the child can also trigger an alarm himself by disconnecting his chest strap. The child's receiver has one Group identification code and recognizes only one channel code. The guardian can control more than one channel within the same group ID code to watch over more than one child. The backpack has anti-tamper features such that an alarm will be triggered if someone tries to tamper with the backpack or molest the child.

20 Claims, 7 Drawing Sheets

(FROM FIG.8)
(FROM FIG.8)
(FROM FIG.8)
AA2
U101B
4013B
D
CK
S
R
Q
Q̄
D105
IN4148
+9V
U102-14
C104
0.1μF
U102-7
U101-14
C105
0.1μF
U101-7
R127
1.2K
Q109
2N3906
LED
102G
GREEN
R126
6.8K
R125
1.2K
Q101
2N3904
LED
102R
RED
+18V
R124
10K
R128
3.3K
U102A
LM393
U102B
(FROM FIG.8)
+5V REG
R129
4.22K
R130
4.22K
R131
42.2K
TAMPER DETECT
C102
.01μF
R107
68K
D104
IN4148
D103
IN4148
R111
22K
R112
1K
CHEST STRAP
CONNECTOR
R113
1K
R110
22K
Q105
2N3904
52
+9V
R108
27K
R109
1.2K
+18V
AUX.
BATTERY
DETECT
AAI

CHILD ALARM

FIELD OF INVENTION

The present invention relates to proximity circuits which provide an audible alarm on a child when the child wanders beyond a preset distance from his guardian. The device is packaged into backpacks, belts, and the like. An audible alarm on the child helps deter kidnapping.

BACKGROUND OF THE INVENTION

A recurring nightmare for parents is to be separated from their child in a crowded environment such as a shopping mall. The child could wander off and get lost. This could provide an opportunity for kidnapping or injury. There is a need for a device which alerts the guardian, the child, and persons in the vicinity of the child of a potential problem if the child is not in the proximity of the guardian. Previous efforts to solve this and related problems are covered in the following patents.

U.S. Pat. No. 4,136,338 (1979) to Antenore discloses an area perimeter alarm system using a buried wire. A monitored user carries a transmitter which imposes a signal on the wire. When the user strays beyond the perimeter, an alarm is triggered.

U.S. Pat. No. 4,476,469 (1984) to Lander discloses a locator means for assisting in locating an object. It comprises a hand held searcher and a miniature locator which can be manually activated to find a key ring and the like.

U.S. Pat. No. 4,593,273 (1986) to Narcisse discloses an out-of-range personnel monitor and alarm suited for mental institutions. The system has a base unit that transmits to a mobile unit. If the mobile unit loses signal strength, it transmits that information to the base unit triggering an alarm.

U.S. Pat. No. 4,694,284 (1987) to Leveille et al. discloses a radio transmitter in a band worn by a child. Even if the band is unlocked the radio signal continues, thereby enabling a rescue attempt.

U.S. Pat. No. 4,785,291 (1988) to Hawthorne discloses a child alarm system. The receiver AGC level provides an LED and audible alarm upon preset distance being attained from the child.

U.S. Pat. No. 4,888,580 (1989) to Distel discloses a string activated magnetic alarm switch.

U.S. Pat. No. 4,973,944 (1990) to Maletta discloses RF circuitry mounted on a user. When the user leaves an area boundary set by a receiver, the receiver alarms. Also taught is a mounting band for the RF circuitry which, if broken, also sounds an alarm.

U.S. Pat. No. 4,899,135 (1990) to Ghahariiran discloses an ultra sonic based child alarm system. If the child strays, then the guardian's unit alarms. The guardian can then activate an audio alarm in the child's transceiver to assist locating the child.

U.S. Pat. No. 4,999,613 (1991) to Williamson et al. discloses a prisoner monitoring system.

U.S. Pat. No. 5,021,794 (1991) to Lawrence discloses a UHF radio direction finding system for a lost child.

U.S. Pat. No. 5,119,072 (1992) to Hemingway discloses a child alarm system using FM RF signals to send a first distance calculating signal to determine proximity. Then a second microphone signal is transmitted when the child strays from the mother.

U.S. Pat. No. 5,115,223 (1992) to Moody discloses a monitoring and tracking system. The user's band is tamper resistant. Radio signals indicate distance and direction of the user.

U.S. Pat. No. 5,175,868 (1992) to Yasuoka discloses a radio interference resistant lost child transmitter/receiver.

U.S. Pat. No. 5,196,825 (1993) to Young discloses a child's homing device also having a child activated alarm sending transmitter.

U.S. Pat. No. 5,235,322 (1993) to Obysovsky et al. discloses a manually activated wrist band audio alarm system to prevent mugging.

U.S. Pat. No. 5,245,314 (1993) to Kah, Jr. discloses an RF signal location monitor. An intermittent battery saving transmitter activates an alarm sounding receiver.

U.S. Pat. No. 5,289,163 (1994) to Perez et al. discloses a child alarm system using RF signals. A direction indicator using LEDs helps the guardian walk toward the location of the child who has strayed beyond a preset distance.

U.S. Pat. No. 5,298,883 (1994) to Pilney et al. discloses a pair of transmitter/receivers which audibly beep at a rate relative to separation distance. A direction finder is included.

U.S. Pat. No. 5,307,763 (1994) to Arthur et al. discloses a buried wire area alarm system.

Applicant believes that '135 is the closest known prior art. The present invention is similar to '135 in that the child can be alarmed, but with '135 the alarm trigger requires a second transmitter link and human intervention. With the present invention the child is virtually an electronic time bomb waiting for the triggering event to occur. Thus, the present invention is simpler in functionality than the prior art and eliminates human intervention. The child's alarm will be activated when the child leaves the preset perimeter of the guardian. The alarm will also be activated when the child's harness is tampered with by a perpetrator. Additionally, the child can set off his own alarm purposefully if he is molested. The present invention differs from the prior art by: 1) The child's alarm device is intended to automatically alert everyone around the child that he is possibly in serious trouble. All the people can then be witnesses, or can possibly assist in rescuing or helping the child. 2) The guardian can alternatively control a one-way transmission because he has the only transmitter, and he can activate the child's receiver at any time to locate him.

In summary, the present invention is the only known invention which focuses on automatically setting off an alarm on the child when he wanders beyond a preset distance from his guardian.

SUMMARY OF THE INVENTION

The main object of the present invention is to provide an audible alarm on a child which will automatically activate within seconds of a kidnapping.

Another object of the present invention is to provide a 'FIND' function to manually activate a beeper and alarm the child when you want to find him.

Yet another object of the present invention is to provide multiple tamper proof systems on a child's backpack which carries the alarm.

Other objects of this invention will appear from the following description and appended claims, reference being had to the accompanying drawings forming a part of this specification wherein like reference characters designate corresponding parts in the several views.

Before allowing a child to wander the guardian turns on the child's receiver. The receiver PC board subassembly is securely mounted in a plastic enclosure that is held closed by a minimum of 4 screws. An external wire exits the enclosure at its top end, and acts as the RF energy receiving antenna.

When it is first turned ON, the on-board 'FIND' beeper beeps briefly. When ON, it is always receiving on a fixed, tuned, frequency. The countdown timer is always running, and it is always considered to be "Armed".

If he chooses the guardian can look at the receiver enclosure box to check the condition of the internal main battery by observing a 3 color display LED. If the LED is Green the battery is good. A Yellow color indicates that the battery is still OK. A Red LED indicates that the main battery should be replaced. Another indication of battery voltage and life is the beeper loudness, which decreases with battery supply voltage.

In order to calibrate or determine the maximum range of the child, the guardian can press either of the 2 'FIND' buttons to activate periodic transmission/reception, and then check signal strength and range. The presence or absence of the audio alarm signal can be utilized to indicate the actual border of the transmission range. Final realistic range testing needs to be performed with the backpack or other receiver holder on the child.

The backpack is then put on the child, and strapped on using the tamper-resistant harness system. Internal wires run from the receiver PC board and out through all the straps which hold the backpack to the child. The harness has a latching buckle. The latch has an electrical contact that closes a detection circuit for all the strap wires. When the receiver has been turned ON, if the strap wires are cut or the contact is opened by someone, the logic circuit immediately latches the 'HELP' beepers 'ON'. The beeper alarm continues until the receiver is RESET by the guardian's transmitter, even if the contact is reconnected. This can also serve as the child's "panic button". He just unlatches his harness strap buckle if he's old enough to be able to). A second lockable catch ms optionally added. In this design only the guardian can actually remove the pack. The backpack version has a steel reinforced top rim. The receiver electronics could also be enclosed in a fanny pack or on a hidden ankle strap. A further embodiment is disguised as a wristwatch and attached around a child's wrist.

In operation the guardian uses his dual channel transmitter to ENABLE one or two transmission channels. When manually transmitting a channel, as in the 'FIND' mode the transmission is set at a boosted power to get more range. When using the 'FIND' feature, the child's beeper gradually gets louder as the ON time increases (on for<6 or 7 seconds results in maximum volume). In the normal mode of operation, the guardian can just briefly transmit a channel to ENABLE it. Then that channel will automatically transmit a 'TIMER RESET' code every 4 seconds (approximately) to a matching ON and ARMED receiver. When a child's receiver stops getting the RESET code because it's out of range, two audible alarm beepers latch ON. The beepers can only be turned OFF by a 'RESET' code from the guardian's transmitter.

The wires to multiple beepers are sewn into tough nylon which is sewn in between the inner and outer layers of the backpack.

For the child's receiver, an auxiliary 9 VDC battery is located in a simple pouch inside the pack in an obviously accessible position. If this battery is removed by someone trying to disable the system when the receiver is turned ON, then the 'HELP' beepers latch ON immediately. The primary 9 VDC battery is hidden from view, attached to the receiver printed circuit board to provide the main power and also power the alarm in the event the auxiliary battery is removed.

The receiver board is installed in its own plastic enclosure. This box is inserted into a pocket in the backpack's back, and is accessible only through a zippered opening in the inside bottom of the backpack.

The buttons on the guardian's transmitter can be recessed slightly to help prevent accidental transmissions. The buttons are also lower than two raised lettering platforms on the top surface of the hand-held transmitter.

The child's backpack can have an outside pocket for a child ID card, or a permanently sewn-on tag. The parent or guardian can write on as much information as they want on the ID card or tag.

If someone attempts to "jam" transmissions to the child's receiver, then this will cause the timer to time-out and latch the alarm on. For someone to duplicate the guardian's transmission code, they would have to be able to duplicate the exact correct twelve bit code. The twelve bit code allows at least 2048 children with 1024 different "group" or "family" codes to be within range of each other without interference.

Another feature of the electronic design is the use of Surface Mount Devices for electronic components wherever possible. Using these kinds of parts for the system's circuits lowers production and assembly costs, while at the same time increases overall reliability. One of the primary intentions of this system is to keep the cost to the consumer low so it will be available to everyone.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
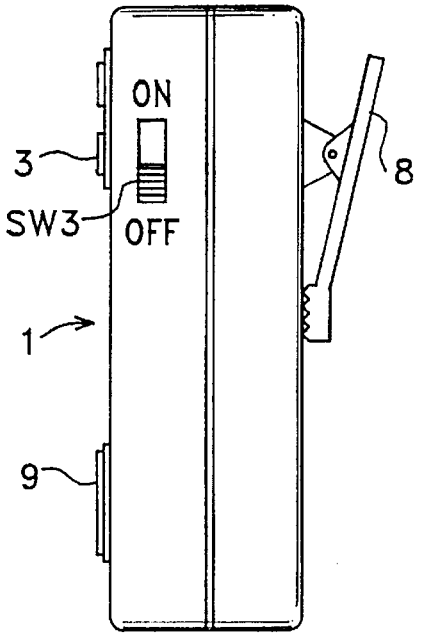
FIG. 1 is a side plan view of the transmitter assembly held by the guardian.
Figure 2:
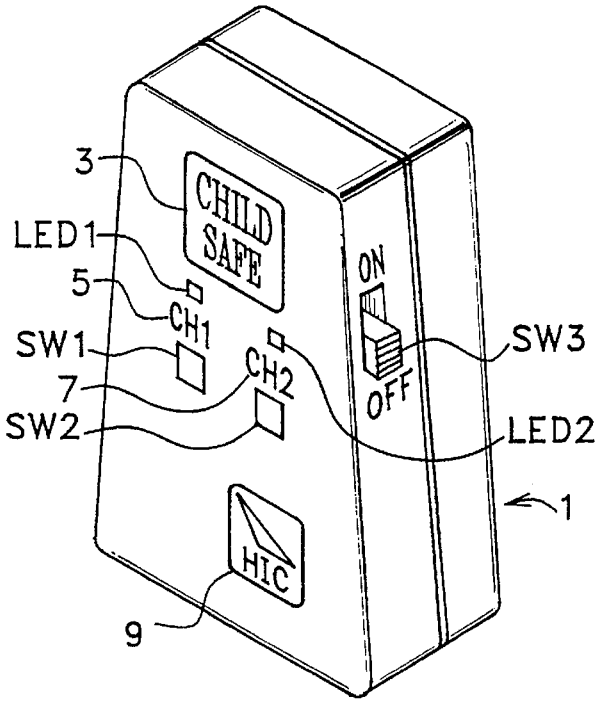
FIG. 2 is a front perspective view of the guardian's hand-held transmitter assembly of FIG. 1.

Referring first to FIGS. 1, 2 the transmitter assembly 1 is shown in its preferred embodiment as a hand-held remote control with an integral belt clip 8. A design choice not shown is a neck pendant worn by the guardian.

Figure 3:
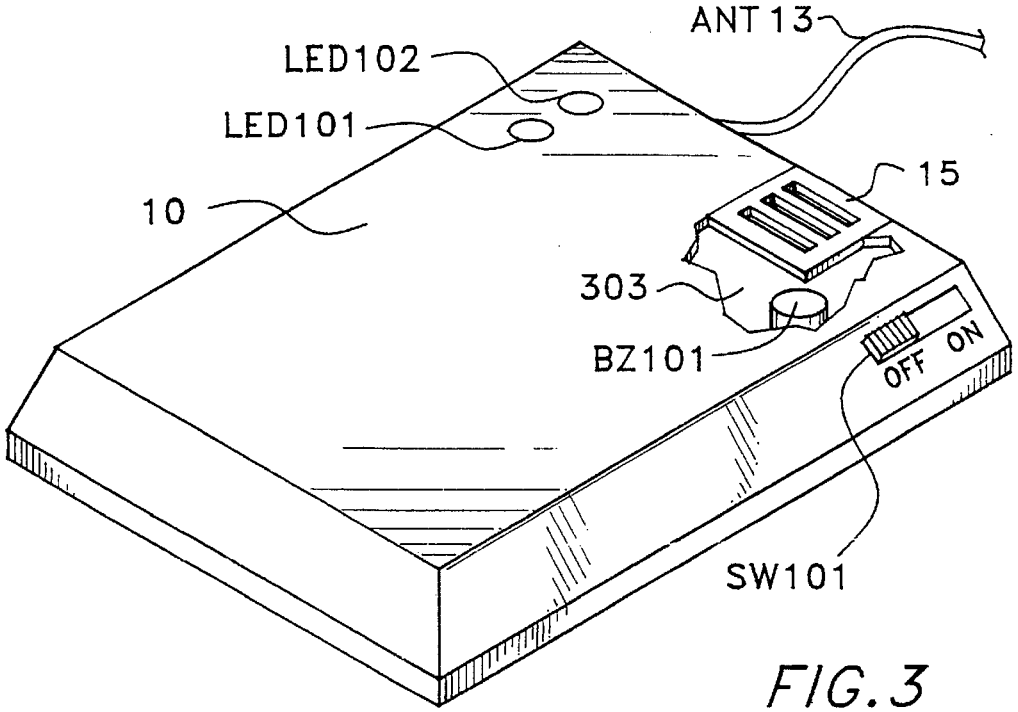
FIG. 3 is a top perspective view of the Receiver Board enclosure that is normally located inside the backpack shown in FIG. 4. A partial cutaway shows a hidden beeper.
Figure 4:
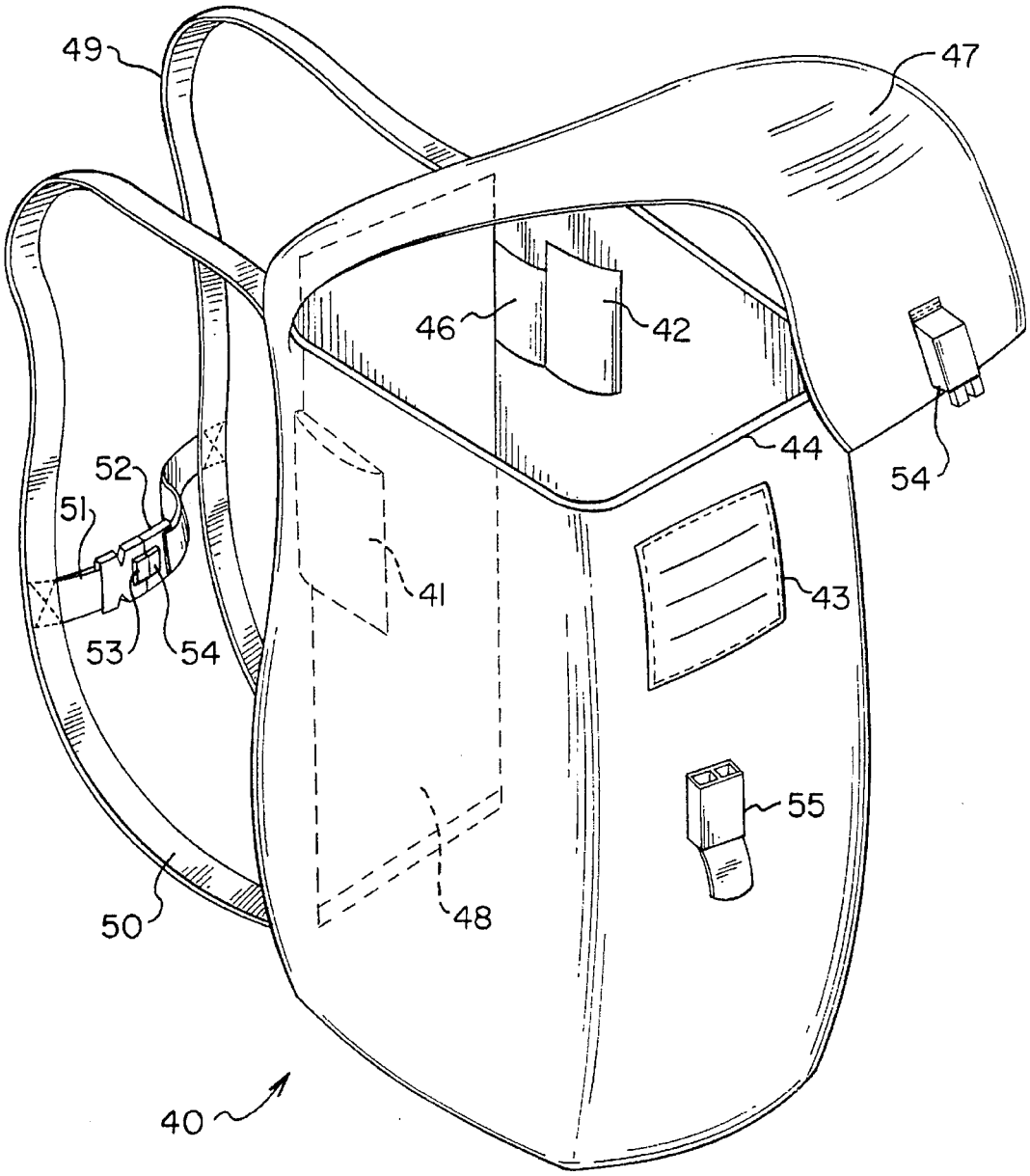
FIG. 4 is a top rear perspective view of the receiver assembly worn by the child.

Referring next to FIGS. 3, 4 the receiver enclosure box 10 is stored in the hidden receiver pocket 48 of the receiver assembly 40 disguised as a backpack. The receiver assembly 40 has a steel reinforced rim 44 to help prevent cutting or tampering. The receiver assembly 40 can also have an ID card pocket or tag 43 and shoulder straps 49, 50. The shoulder straps 49, 50 are connected together by a chest strap 51 that has a latching buckle 52 that can allow some strap length adjustment. The strap buckle 52 has an integral or externally attached 2-position electrical connector that has separate male and female connectors 53 and 54 respectively. The backpack top 47 is closed by latches 54 and 55.

The transmitter assembly 1 has two labeled channels, with a third one possible. The labels CH1 and CH2 (5 and 7 respectively) are on the face of the transmitting assembly 1. The two channels allow the transmitter assembly 1 to operate with one or two different child's receivers simultaneously. Each receiver assembly 40 has its own twelve bit code word, with bits 1 through 10 being the Group code and bits 11 and 12 being the channel number.

Any number of standard off-the-shelf transmitters and receivers could be adapted for use in this application. One such example of a set of circuit boards would be the TX-99 or TX-99K transmitter/encoder, together with the RE-99 receiver and RE-01D decoder boards. These are available from MING Microsystems and their various distributors. The transmitter and receiver form an RF link.

The transmitter assembly 1 has three possible modes: STAND BY-on but not transmitting, ENABLED-transmitting periodically automatically, and MANUAL-transmitting when one of the FIND push button switches SW1, SW2 is pressed. When in the ENABLED mode, the transmitter sends a code for the ENABLED channel(s) (multi-channel signal generating means) every 4 seconds automatically (periodic signal generating means). When the matching receiver is moved out of the range of the transmitter for more than approximately 10 seconds, the alarm beepers, located in pockets 41, 42 and connected to the receiver board are latched ON. The MANUAL mode of transmission (manual signal generating means) is used to 'FIND' a matching receiver and also RESETs a latched on alarm mode for the receiver beepers. The MANUAL mode triggers a single beeper at the receiver 10 when the appropriate push button switch SW1 or SW2 is pushed on the transmitter 1. The key to the MANUAL mode is that the receiver has to recognize a valid code for >0.5 seconds for it to RESET an alarm condition and/or turn on the 'FIND' beeper.

In operation, the device is turned on by the ON/OFF power switch SW3. The transmitter 1 is now in a STANDBY mode and initially does not transmit. Channels one, two, or both can be selected and ENABLED using the 'FIND' push button switches SW1, SW2 located on the front panel of the transmitter 1. There are two slightly raised platforms 3, 9 on the front of the transmitter 1 to help prevent accidental activation of the FIND push button itches SW1, SW2

When the receiver is turned ON by ON/OFF switch SW101, it is immediately "Armed". The BATTERY LEVEL three color light emitting diode LED 102 on the receiver enclosure 10 will light up. The three color light emitting diode LED 102 is constructed with two LED's, LED 102R and LED 102G in the same package LED 102. Checking the main receiver battery (not shown), observing is done by the battery level indicator LED 102. Green indicates battery good, Yellow indicates battery OK, Red indicates battery replacement. If the LED is off, then the battery is dead or missing and should be replaced. The auxiliary 9 VDC battery not shown) is located inside the backpack 40 in an accessible pocket 46. The pocket has a hook and loop or other temporary closure. If the auxiliary battery (not shown) is removed from the circuit, the 'HELP' beepers latch ON immediately, powered by the hidden main 9 V battery (not shown) inside enclosure 10.

The receiver (not shown) is mounted on a PC board 303 inside the receiver enclosure box 10. The armed receiver (not shown) will RESET a≦10 second reset timer every time it receives a valid code signal from the transmitter 1. The transmitter 1 will send a 0.20 second signal pulse for each selected channel every 4 sec (±0.5 sec tolerance). On each transmission, the respective LED, LED 1, LED 2 for the channel transmitted will light. The receiver gets the RF signal via the wire antenna ANT13. The VALID XMIT amber-colored LED 101, lights up for as long as a valid transmission is received. The receiver 10 can miss one transmission and not go into the alarm mode. When the 10 second timer in a receiver times out, the receiver's beeper control logic will latch into the alarm mode. This mode can only be cleared by the transmitter's 1 RESET command issued by pressing the push button suit SW1 or SW2 for the appropriate channel for >0.5 seconds. The receiver's 10 alarm mode consists of turning ON two>90 dB pulsating piezoelectric audio beepers wired in parallel. These 2 beepers are located in closed pockets 41 and 42, located on opposite sides of the backpack 40, making it difficult to cover and muffle both beepers at the same time. The dual beepers are connected to the receiver via an internal enclosure and external wires (not shown). At any time, the guardian can press the 'FIND' push button switch SW1 or SW2 activating that single channel's 'FIND' mode beeper BZ101. The 'FIND' mode beeper BZ101 will start beeping about 0.5 seconds after the FIND mode is initiated. This beeper BZ101 is located on the receiver PC board inside enclosure 10 with openings 15 for the audio signal. The 'FIND' mode beeper BZ101 starts at a low volume, and after about 6 seconds the volume will have increased to its maximum level. The 'FIND' mode can be activated on either channel, but not both at the same time. An independent third channel, "Channel 3", could be implemented by pressing both channel buttons 1 and 2 at the same time. The 'HELP' alarm mode and the 'FIND' mode could have specific pre-recorded voice messages in place of, or in addition to, the beeper alarms described.

Figure 5:
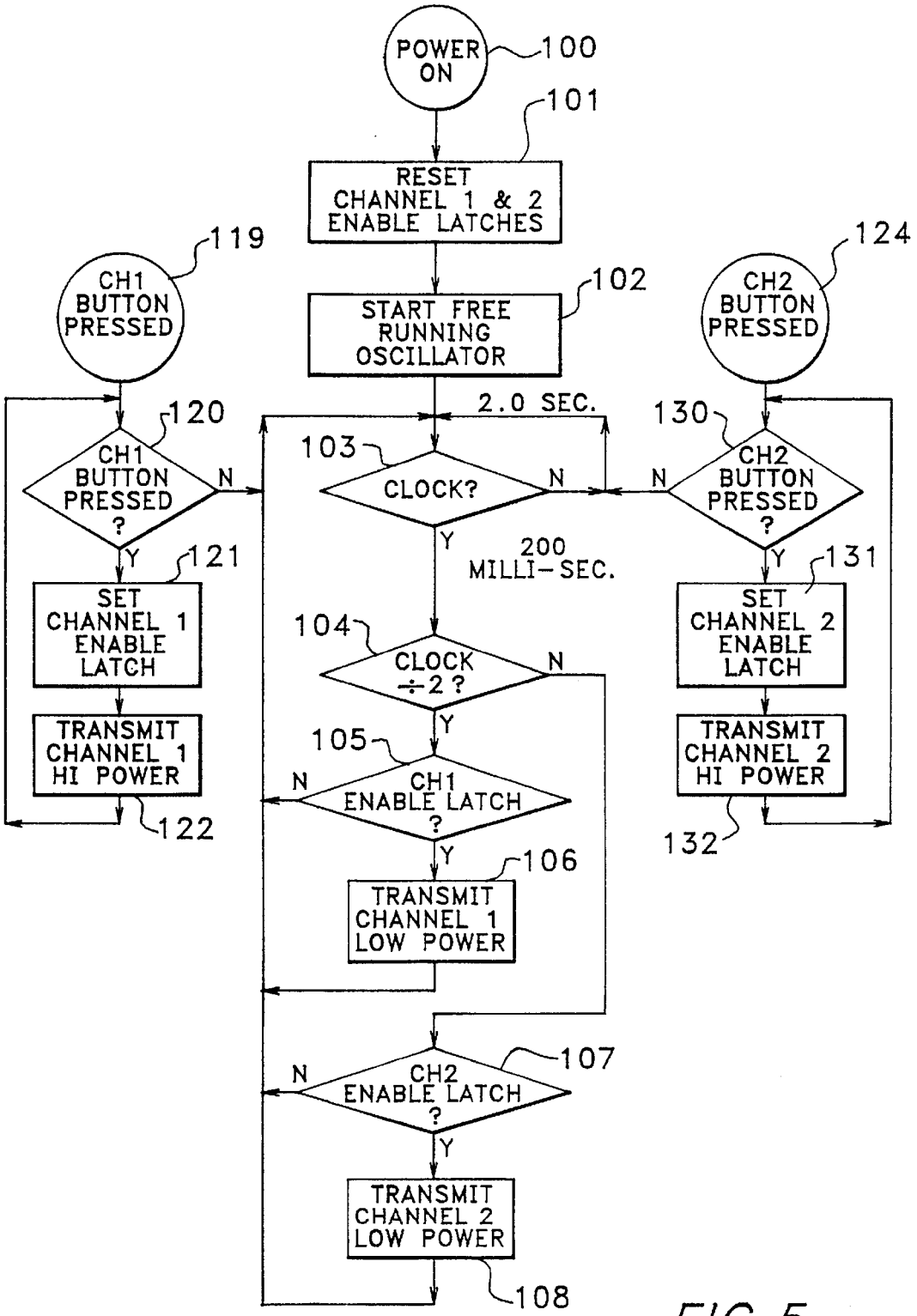
FIG. 5 is a flow chart of the circuit logic in the guardian's transmitter assembly.
Figure 6:
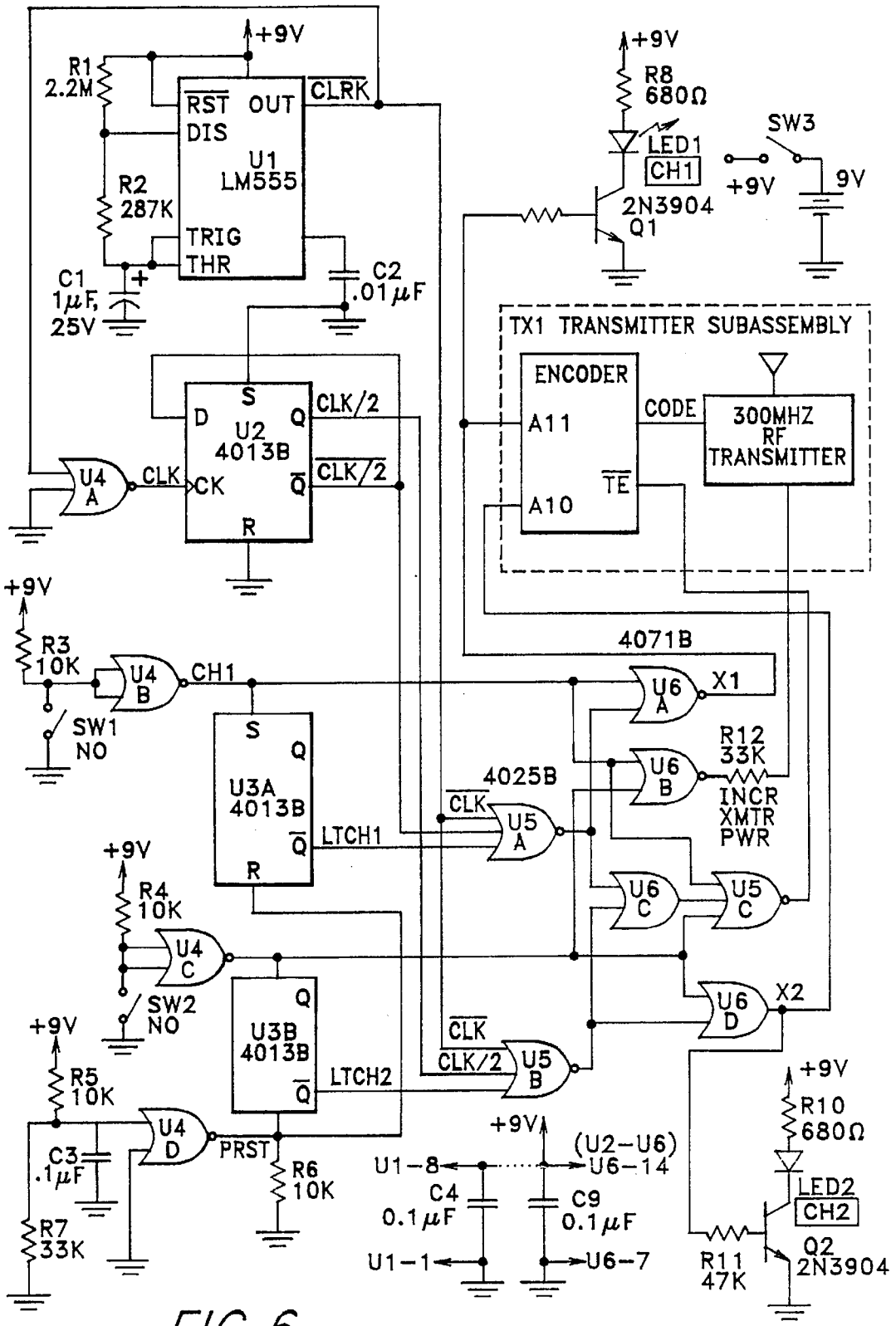
FIG. 6 is an electrical schematic diagram for the guardian's transmitter assembly shown in FIG. 5.
Figure 7:
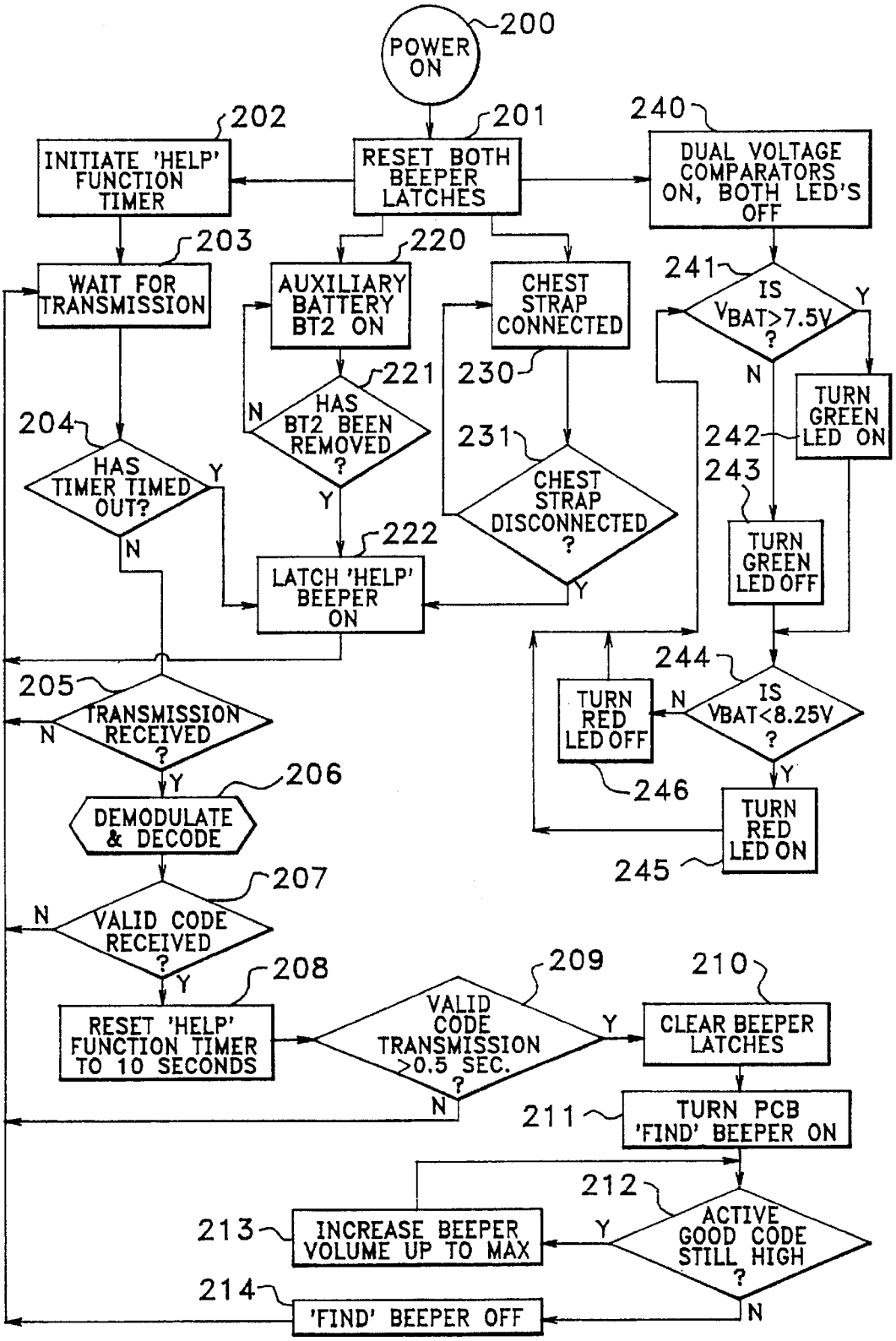
FIG. 7 is a flow chart of the circuit logic in the child's receiver assembly.
Figure 8:
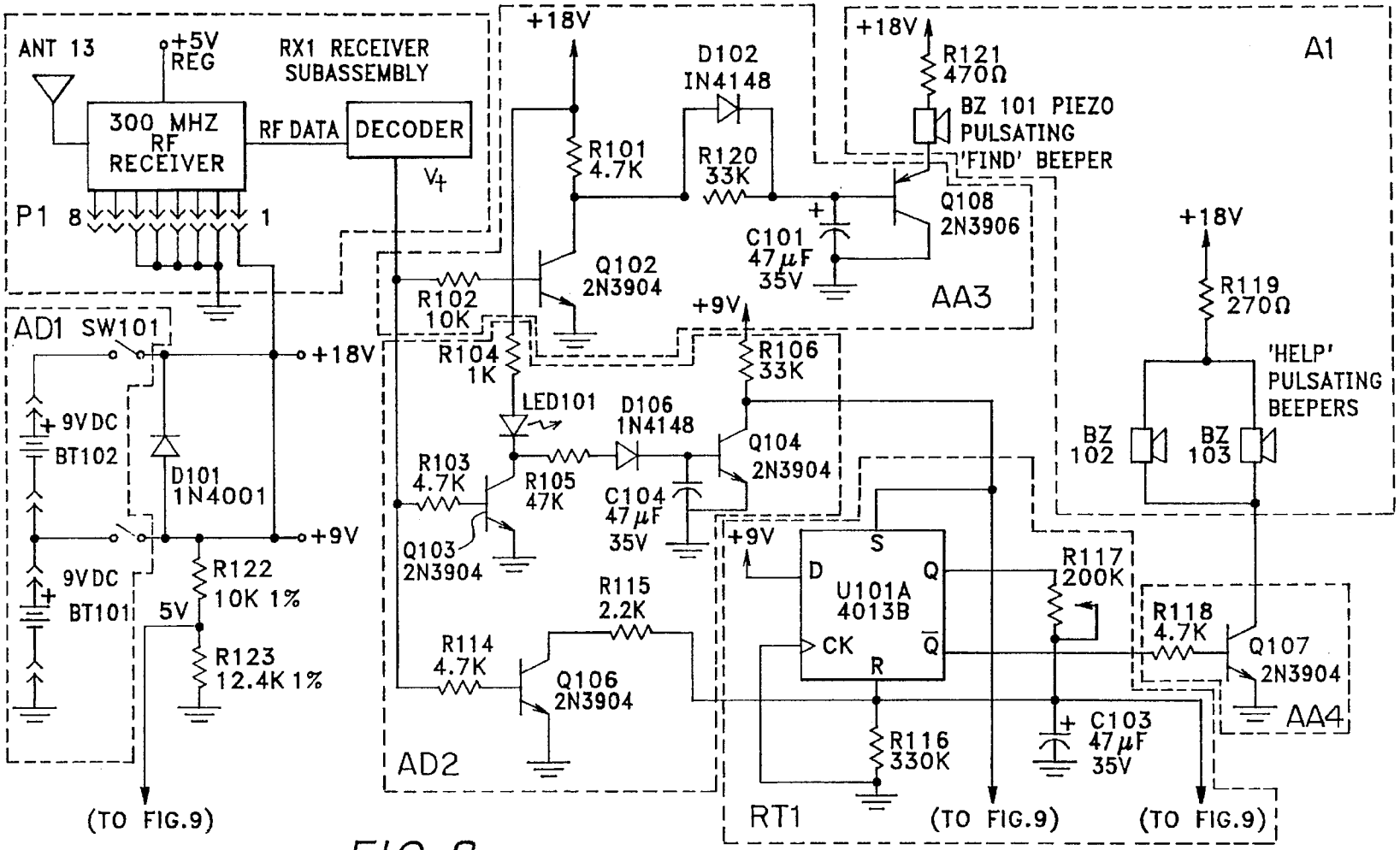
FIGS. 8–10 are an electrical schematic of the child's receiver assembly shown in FIG. 7.
Figures 8, 9, 10:
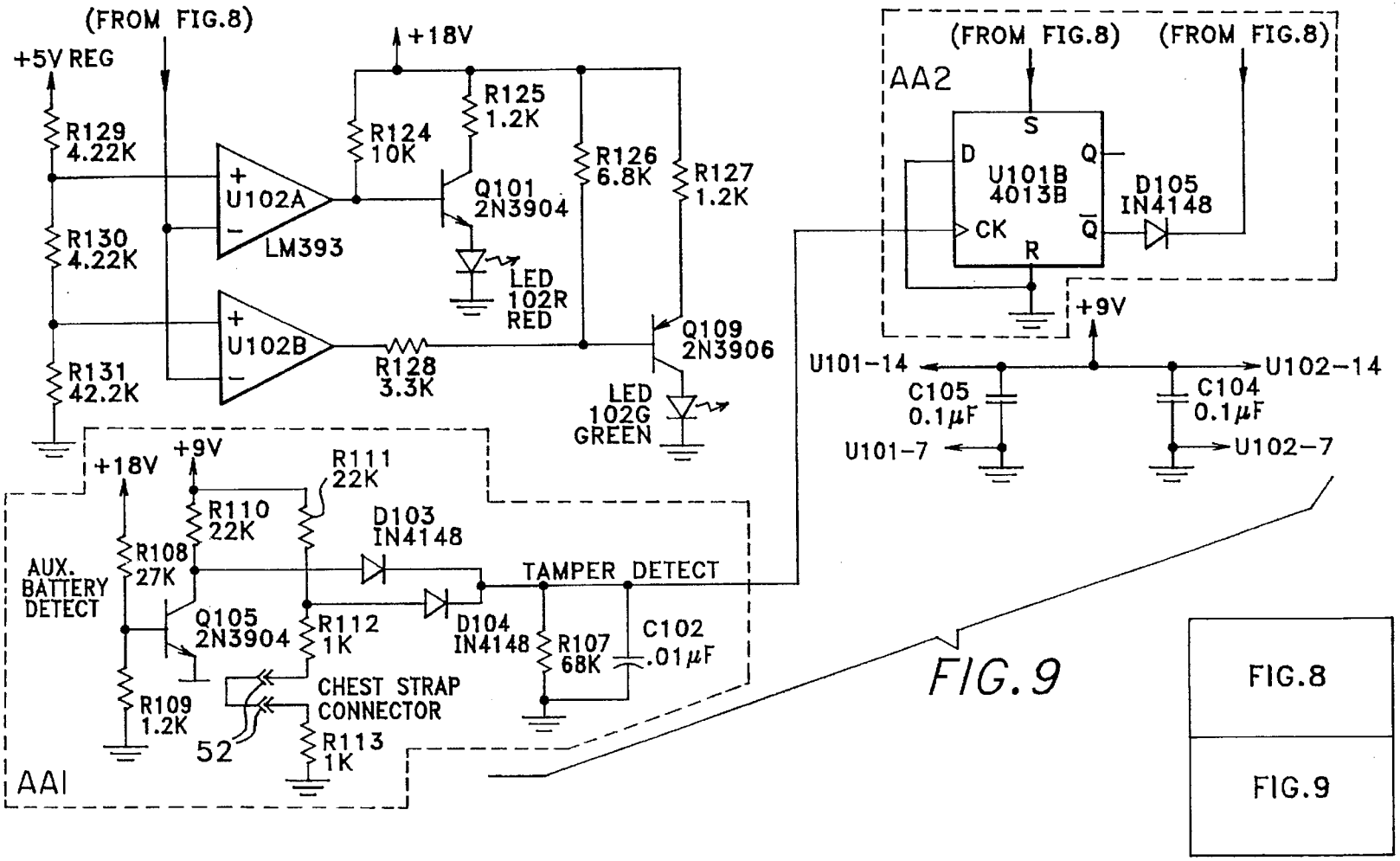

Referring next to FIG. 5, a flow chart for the transmitter assembly 1 is shown. FIG. 6 shows the schematic that implements the flow chart of FIG. 5. The following will describe the transmitter assembly schematic and the transmitter flow chart or block diagram concurrently.

On the application of power, as shown in flow chart block 100, capacitor C3 is charged through resistor R5. The voltage on C3 at the input of U4D is held low momentarily until C3 becomes charged. The final voltage on capacitor C3 will be determined by the voltage divider found by resistors R5 and R7. The output of U4D steps high, for this charging period thus creating a reset pulse. The reset pulse at the output of U4D RESETs both channel 1 and channel 2 enable latches U3A and U3B as shown in block 101. Resistor R6 provides a load on the output of gate V4D.

The free running oscillator shown in flow chart block 102 is started when power is applied. The free running oscillator is implemented by timer U1. The frequency and duty cycle of the oscillator is determined by R1, R2, and C1. C2 is a bypass capacitor required by the circuit used in the timer U1. The output of the timer U1 is a 200 millisecond (approx.) low-going pulse at a repetition rate of one per two seconds or 0.5 Hertz. Block 103 is a decision block that is true only during the 200 milliseconds of the pulse. Block 103 will, therefore, be a two second delay. NOR gate U4A is used as an inverter to provide the proper polarity to the U2 clock input. The 'D' type flip-flop U2 is a divide by two circuit used to separate the channel 1 and channel 2 clocks in conjunction with NOR gates U5A and U5B. Thus U2 is a channel selector timer and could be expanded if more channels were required. Decision block 104 selects the channel 1 and channel 2 clocks.

R3 and R4 hold the inputs to inverters U4B, U4C high. When one of the push-button switches SW1 or SW2 for channel 1 or channel 2 respectively is pushed, the input to U4B or U4C will go low. On the pressing of SW1 or SW2, then either Blocks 119, 120, and 121, or Blocks 129, 130, and 131 of the flow chart will be entered immediately. When the input of inverter U4B or U4C goes low because of a switch closure, a high will appear at the output. The outputs of U4B and U4C set the channel 1 and channel 2 enable latches U3A and U3B respectively, as shown in blocks 121, 131. During the time that one of the switches SW1 or SW2 is closed the transmitter module TX1 will be set to a boosted high transmit power level by gate U6B and input Resistor R12. The switch closure will also activate the proper bit code in the transmitter module TX1 via gate U6A and U6D as shown in blocks 122 and 132. The transmitter will remain active for as long as either SW1 or SW2 remains pressed thus achieving a manual signal transmitting means.

Once the latches for channel 1 U3A, channel 2 U3B, or both have been set, blocks 105 and 107 will allow the transmitter module TX1 to transmit for approx. 200 milliseconds. Blocks 106 and 108 show the transmission which will continue for the 200 milliseconds that satisfies Block 103. The above function is achieved by gates U5A and U5B. Gates U5A and U5B drive the transmitter module's TX1 address inputs for channel 1 and channel 2 respectively via gates U6A and U6D. Gates U5A and U5B also drive the TX1 transmitter module's 'Transmit Enable' input via gates U6C and U5C.

When a transmission is occurring on channel 1 the voltage at the output of gate U6A will go high. The output of U6A will drive the voltage at R9 high. The high voltage at base resistor R9 will turn on transistor Q1. Transistor Q1 will draw current through light emitting diode LED1 and current limit resistor R8, thus giving a visual indication of channel 1 transmission.

When a transmission is occurring on channel 2 the voltage at the output of gate U6D will go high. The output of U6D will drive the voltage at R11 high. The high voltage at base resistor R11 will turn on transistor Q2. Transistor Q2 will draw current through light emitting diode LED2 and current limit resistor R10, thus giving a visual indication of channel 2 transmission.

Power switch SW3 connects the 9 volt battery 9V to the electronic circuitry. C4 through C9 are power supply bypass capacitors for filtering of the 9 volt supply or the integrated circuits U1 through U6.

Referring now to FIGS. 7–10, the flow chart block diagram and receiver schematic are shown respectively. FIGS. 7–10 will be discussed concurrently. The receiver schematic covers the circuitry on PC board 303.

Switch SW101, a DPDT slide switch, connects primary battery BT101 and secondary battery BT102 to the receiver and control circuits. As soon as power is applied, as shown in flow chart block 200, both beeper latches are RESET or cleared so the beepers are all OFF, block 201. Then the 'HELP' beeper reset timer is initiated, block 202. The RF receiver also begins to operate immediately, block 203. The RED/GREEN LED's in a single package, LED 102R, LED 102G is a BATTERY LEVEL indicator and is turned ON or OFF by a battery level detect circuit, block 240. If RF receiver RX1 is within the threshold range of the RF transmitter then the signal strength of the RF signal is such that a valid signal can be decoded. The RF receiver subassembly RX1 includes a fixed 5 V regulator supplied by the 9 VDC battery BT101. The 9 V battery BT101 voltage drops as its life decreases but is still usable down to about 7.5 VDC. The circuit using a dual comparator U102 decides which LED or LEDs to turn on as determined by actual battery voltage.

The fixed 5 V is used as an input reference voltage divided down by resistor divider R129, R130, R131 to provide two fixed voltage outputs equivalent to 92% and 83% of the battery voltage. The 9 V battery BT101 voltage is divided down to 5 V by the voltage divider R122 and R123. This input to both comparators drops below 5 V as the battery voltage drops below 9 V. As long as battery voltage $V_{BAT}$ is above 83% of 9 V, block 241, then the Green LED is turned ON, block 242. The output of U102B is low, which turns ON drive transistor Q109 through base resistor R128. The Green LED LED102G, which has a common cathode with the integral Red LED LED102R, is supplied current through limit resistor R127 and Q109. When $V_{BAT}$ drops below 92%, block 244, comparator U102A toggles its output and goes high, turning ON Q101 through base bias resistor R124. This turns ON the Red LED LED102R, block 245, from the +18 V (or 9 V) supply through current limit resistor R125. Since the Green LED LED102G is still ON, with the Red on at the same time the LED appears to be Yellow. When the voltage drops below 83%, the comparator U102B toggles high also, which turns OFF transistor Q109 when its base is pulled high by R126, and the Green LED goes OFF, block 243. Now only the Red LED is ON, which indicates the need to replace the main PCB 9 V battery. When $V_{BAT}$ is above 92% of 9 V, then the Red LED is turned OFF, block 246.

At initial power up, transistor Q104 is OFF, therefore, its collector is pulled high to +9 V through R106. This then supplies a logic 1 level to the SET inputs of Dual D Flip Flop U101A and U101B. This causes the Flip Flop's Q outputs to go high and $\overline{Q}$outputs to go low. This is shown as block 201 in the flow chart FIG. 7. The timer has now been set, block 202, and capacitor C103 begins to charge up through adjustable trimmer pot R117. The trimmer pot is used to set the delay time to 10 seconds ±0.5 seconds. Now the timer waits for a valid transmission $V_T$, block 203, and a valid RESET command from its matching transmitter. If the timer times out, block 204, when the capacitor C103 voltage at the Flip Flop RESET pin reaches a logic level 1, the U101A's Q output pin goes low and the $\overline{Q}$output goes high. This positive output turns ON transistor Q107 as it is supplied with base current through base resistor R118. When Q107 is ON, collector current flows from the +18 V battery supply, through current limit resistor R119, into the dual pulsating beepers BZ102 and BZ103, and finally through Q107 to ground return. The beepers are now "latched" ON as shown in flow chart block 222.

When a transmission of the correct tuned frequency, somewhere in the 300 to 318 MHz range, is received by the receiver subassembly RX1, block 205, the decoder section checks for a valid code, block 206. A 12-position DIP switch (not shown) on the receiver subassembly RX1 sets the ID code for the XMTR/RCVR pair. The decoder compares at least 3 received codes with the set ID code, and if they are the same it pulls its valid transmission ($V_T$) output high to +5 V, for as long as a good transmission is received, block 207. The $V_T$ output drives three transistors, Q102, Q103, and Q106, and the length of the $V_T$ pulse determines what happens for each one. When $V_T$ goes high, transistor Q106 is turned on through base resistor R114 immediately. This provides a discharge path to ground for the voltage that has been charging up capacitor C103. When C103 discharges through limiting resistor R115 and transistor switch Q106, the 10 second reset timer function is essentially RESET to 10 seconds, as shown by block 208. Resistor R116 together with R117 is a voltage divider and slow discharge path for C103 when power has been turned OFF. The 200 msec periodic pulse from an ENABLED transmitter is long enough to turn on Q106 and almost completely discharge C103. This same short pulse into Q103 through base resistor R103 turns Q103 ON briefly. This allows collector current to flow through R104 and the visible amber-colored light emitting diode LED 101. This provides a visible indication of a valid code reception, whether it was from a short automatic or manual transmission. When Q103 is ON, its collector is held near ground, thereby taking away the current path from +18 V, through R104, LED 101, R105, and forward-biased diode D106 to turn ON transistor Q104. Normally this path charges up storage capacitor C104 and keeps Q104 ON, thereby pulling down resistor R106 and keeping the SET input of U1 low, or inactive. When a $V_T$ turns ON Q103, and the DC base current path for Q104 is disabled, then Q104 would start to turn OFF. However, the charge on C104 is enough to provide some base current for Q104, keeping it ON briefly and preventing the collector and SET input from being pulled high immediately through R106. The signal diode D106 prevents C104 from discharging through R105 into ON transistor Q103. Therefore, VT pulses less than about 400 msec in duration are 'filtered out' and do not SET the Flip Flop latch U101. Eventually Q104 will turn OFF when $V_T$ pulses are>about 0.5 seconds, block 209, and the SET input will reach a logic 1 level. This "SETS" the FF's latch, causing the $\overline{Q}$output to go low, turning OFF the 'HELP' beepers, block 210.

The $V_T$ pulse is also connected to transistor Q102 through base resistor R102. This pulls the collector low through resistor R101, providing a discharge path for capacitor C101 through timing/base resistor R120, but not through paralleled back-biased diode D102. As current begins to flow in this path, transistor Q108 starts turning ON, providing a supply current path from +18 V, through collector resistor R121, into the pulsating piezoelectric audio beeper BZ101, turning it ON, block 211. This current flows through Q108 and returns to ground. As capacitor C101 discharges, the base voltage of Q108 decreases slowly, which turns Q108 on harder, allowing more collector and beeper current to flow. If $V_T$ remains high, block 212, the collector-emitter voltage $V_{CE}$ of Q108 drops, the voltage across the beeper BZ101 increases, allowing its audio volume to increase significantly, block 213. When $V_T$ has been high for about 6 or 7 seconds, the beeper BZ101 reaches its maximum volume. As soon as the $V_T$ pulse ends, block 212, Q102 turns OFF. This provides a path to quickly pull up the base of Q108 to turn it OFF, as C101 charges up through R101 and forward-biased diode D102 (in parallel with resistor R120). As Q108 turns OFF, beeper BZ101 is turned OFF in <1 second, block 214. Because of the charge on C101, here again as with Q103, short periodic $V_T$ pulses at Q108 are not enough to make beeper BZ101 audible. A pulse or constant transmission of>0.5 sec is long enough to not only SET the latch and clear an alarm, it is enough to start turning ON beeper BZ101.

Tamper Detection

There are two methods of TAMPER detection— removal of the AUXILIARY 9 V battery BT102 or opening the latch/electrical connector of the backpack chest strap.

Normally battery BT102 is in series with BT101 and provides +18 V to the beepers to help make them much louder than they are at only +9 V. The +18 V is also provided to transistors Q102, Q103, and Q105 as soon as SW101 is closed, block 220. Diode D101 is then back biased and there is no current flow through it. The voltage divider set by R108 and R109 provides>0.60 volts to the base of Q105 where the +18 V is present, thereby turning Q105 ON. Its collector is pulled low through resistor R110, so diode D103 does not conduct and there is no clock input CK to U101B, the second half of the 4013B Flip Flop. The CK input is held low through resistor R107. If the battery BT102 is removed, block 221, then the +18 V supply decreases one diode drop $V_f$ below +9 VDC, as backup power is supplied by the main battery BT101 through forward-biased diode D101. In this case, the voltage divider R108 and R109 do NOT provide enough base voltage to keep Q105 ON, so the collector pulls high, diode D103 conducts and there is a rising CK pulse at the U101B Flip Flop. Because the D input of the Flip Flop is tied to ground, a logic 0 is output at Q and the $\overline{Q}$output goes to a logic 1. Then D105 conducts and charges C103 immediately. This causes a RESET input to the U101A Flip Flop which makes U101A's $\overline{Q}$output go high and latches the 'HELP' beepers ON, block 222.

Normally the chest strap and electrical connector for the backpack are closed when the receiver is turned ON, block 230. Then the +9 V through resistor divider R111, R112, and R113 provides about 0.75 V to the diode D104. This is enough to forward bias D104 and make it conduct some, but with the forward drop $V_F$ and pull-down resistor R107, not enough to cause a clock pulse at the CK input to the Flip Flop. Capacitor C102 together with resistor R107 comprise a 'filter' to keep random noise on the wires on the strap from generating a spurious clock pulse to U101B. If the strap and connector are opened, block 231, then the diode D104 is pulled up to the full +9 V through Rill. Then diode D104, which is OR'ed together with D103, provides a clock pulse to the CK input of the U101B Flip Flop. As in the case of the auxiliary battery removal, this then causes U101B's $\overline{Q}$output to go high, which RESETs Flip Flop U101A, which latches the dual 'HELP' beepers ON. This latch can only be cleared when a $V_T$ pulse of >0.5 sec is received from the guardian's transmitter. Capacitors C105 and C106 are bypass capacitors for the CMOS IC U101, a 4013B Dual 'D' S/R Flip Flop, and the LM393 IC comparator U102 respectively.

In summary, the periodic signal generating means consists of pushing switch SW1 or SW2. For the multi-channel signal generating means, press both SW1 and SW2. When a switch SW1, SW2 is pressed, the corresponding latch U3A, U3B will be set by logic gate U4B or U4C allowing the clock signal CLK and the channel selector timer U2 output to drive the transmitter subassembly TX1, address input A10, A11, and transmit enable TE input through logic gates U5A, U5B, U6C, U5C, U6A, U6D. The transmitter subassembly TX1 transmits periodically for 200 milliseconds every 2 seconds.

The manual signal generating means also consists of pressing one of the switches SW1, SW2 but in this case, the transmitter subassembly will transmit at a higher power (high power transmit means) as long as the switch SW1, SW2 remains pressed. This is accomplished through logic gates U4B, U4C, U6A, U6B, U6D and the transmitter subassembly TX1.

Blocks 106 and/or 108 and the circuitry U4B, U6A, U6C, U5C, U6D, U5B, U4C constitute a periodic signal generating means and a multi-channel signal generating means.

The encoder in the Transmitter Subassembly TX1 is the signal encoding means. The encoder in Transmitter Subassembly TX1 provides a code word to the transmitter in the Transmitter Subassembly TX1 based on the logic levels from gates U6A and U6D. The transmitter in the transmitter subassembly is the transmitter means and generates the RF signal. The channel selector switch consists of the FIND push button switches SW1 and SW2 and the associated components U4B, U4C and flip flops U3A and U3B. The channel selector switch selects the active channel with signals LTCH1 and LTCH2.

The components of the timer include the clock timer U1 and the channel selector timer U2.

The Receiver Subassembly RX1 has a threshold which must be exceeded in order for the output $V_T$ to go high. The power required to exceed the threshold is set by the threshold receiving circuit in the receiver subassembly RX1. The power transmitted by Transmitter Subassembly TX1 and the range from Transmitter Subassembly TX1 to Receiver Subassembly RX1 determine the power at the threshold receiving circuit in the receiver subassembly RX1.

The decoder portion of the Receiver Subassembly RX1 decodes the channel data from the digital sync word set by the encoder of Transmitter Subassembly TX1 and is thus the decoder means. The Receiver Subassembly RX1 functions to receive a periodic signal and is thus a periodic signal receiving means.

As discussed previously, reset timer RT1 containing capacitor C103, flip-flop U101A and resistors R116, R117 form a reset timer means. The reset timer is reset by the alarm deactivate circuit AD1 and AD2. The alarm deactivate circuit AD1, AD2 operates on initial power application, and by the reception of a 200 msec pulse on valid transmission line $V_T$ if it occurs before the reset timer time out.

The alarm A1 consists of FIND Beeper BZ101 and the two HELP Beepers BZ102 and BZ103 and Resistors R119 and R121 and constitutes the alarm means.

The alarm is activated by the alarm activate circuits AA1, AA2, AA3, and AA4. If the reset timer RT1 times-out, the alarm activate circuit AA4 will turn on alarm A1. If the FIND button SW1 or SW2 on the transmitter 1 for this receiver 10 is manually pressed for 0.5 seconds to 7.0 seconds alarm activate circuit AA3 will turn on alarm A1. Ira battery BT102 is removed from the receiver 10, or the chest strap 51 is disconnected, alarm activate circuits AA1, AA2, and AA4 will turn on alarm A1.

The alarm is deactivated by the alarm deactivate circuits AD1 and AD2. When the power is turned on at the receiver 10 alarm deactivate circuit AD1 and AD2 will reset Reset Timer RT1. When a 0.2 second pulse is received on the valid transmission signal $V_T$ before the reset timer times-out Q106 in alarm deactivate circuit AD2 will reset Reset Timer RT1 by discharging C103. When a 0.5 second or greater pulse is received and then removed on the valid transmission signal, $V_T$ Q104 in alarm deactivate circuit AD2 will reset Reset Timer RT1 by setting flip flop U101A and U101B. Note that when the Help beeper BZ102 and BZ103 is deactivated by a 0.5 second pulse on $V_T$ the Find beeper BZ101 may alarm momentarily at a low volume.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A range sensitive system comprising:

an RF transmitter assembly located on a guardian having a periodic signal generating means, a manual signal generating means, a transmitting means, and a signal encoding means, functioning to encode said periodic and manual signals;

an RF receiver assembly located on a child or object functioning to receive an RF signal from said transmitting means up to a preset distance from the transmitting means, a decoder means which receives said encoded signals, a reset timer means which resets when said periodic signal is received, and an alarm means which activates when said reset timer means times out and when said manual signal is received; and said RF transmitter assembly and RF receiver assembly each further comprising a portable power means.

said RF transmitter assembly further comprises a timer, and a multi-channel signal generating means; and said multi-channel signal generating means comprises a channel selector switch and a channel selector timer.

2. The system of claim 1, wherein said manual signal generating means comprises a switch and a high power transmit means.

3. The system of claim 1, wherein said signal encoding means encodes a group code and a channel number.

4. The system of claim 1, wherein said RF receiver assembly further comprises an alarm deactivate means triggered by a receipt of the manual signal.

5. The system of claim 4 further comprising a tamper proof backpack having a pocket for housing said RF receiver assembly.

6. The system of claim 5, wherein said backpack further comprises a chest strap latch having an electrical connection to said alarm means, functioning to activate said alarm means upon opening said latch.

7. The system of claim 5, wherein said receiver power means comprises a primary battery hidden in a PC board and a secondary battery in an accessible pocket in said backpack, and said secondary battery comprises an alarm activation means functioning to activate said alarm means upon uncoupling said secondary battery from said PC board.

8. The system of claim 5, wherein said alarm means comprises an audio beeper array.

9. The system of claim 8, wherein said audio beeper array comprises a hidden beeper.

10. A child alarm range sensitive system to monitor the distance between a child and a guardian comprising:

a guardian's transmitter having an encoder means functioning to encode signals, a periodic signal generating means, a manual signal generating means, a multi-channel signal generating means, and a transmitting means functioning to transmit multiple channel codes, and a power source;

a child's receiver having a decoder means, a periodic signal receiving means, a resetting timer means functioning to reset upon receipt of the periodic signal and time out upon no receipt of the periodic signal, and alarm means functioning to activate upon time out of said resetting timer means and upon receipt of said manual signal, a power supply, and an alarm deactivate means activated by said manual signal.

11. The system of claim 10, wherein said encoder and decoder means respectively encode and decode a code word for each of said multiple channels.

12. The system of claim 11, wherein said periodic signal generating means and said transmitting means transmits an RF signal, and said periodic signal receiving means receives said RF signal, thereby forming a periodic RF link which conveys the code word over a predetermined distance.

13. The system of claim 12, wherein said manual signal generating means comprises a switch and a means to transmit the RF signal at a higher power than said periodic signal generating means.

14. The system of claim 12, wherein said multi-channel means comprises a channel selector switch and a distinct digital sync word for each channel.

15. The system of claim 12, wherein said decoder means comprises a decoder functioning to decode a sync word specific to the individual receiver.

16. The system of claim 10, further comprising a tamper proof backpack having a pocket for housing said child's receiver.

17. The system of claim 16, wherein said backpack further comprises a chest strap latch having an electrical connection to said alarm means, functioning to activate said alarm means upon opening said latch.

18. The system of claim 16, wherein said receiver power supply comprises a primary battery hidden in a PC board and a secondary battery in an accessible pocket in said backpack, and said secondary battery comprises an alarm activation means functioning to activate said alarm upon uncoupling said secondary battery from said PC board.

19. The system of claim 16, wherein said alarm means comprises an audio beeper array.

20. The system of claim 19, wherein said audio beeper array comprises a hidden beeper.

* * * * *